US012527370B2

(12) United States Patent
Tutunjian et al.

(10) Patent No.: US 12,527,370 B2
(45) **Date of Patent: *Jan. 20, 2026**

(54) GARMENT

(71) Applicants: Jessica K. Tutunjian, Huntington, NY (US); John G. Tutunjian, Huntington, NY (US)

(72) Inventors: Jessica K. Tutunjian, Huntington, NY (US); John G. Tutunjian, Huntington, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/999,458

(22) Filed: Dec. 23, 2024

(65) Prior Publication Data

US 2025/0120462 A1 Apr. 17, 2025

Related U.S. Application Data

(63) Continuation of application No. 18/321,315, filed on May 22, 2023, now Pat. No. 12,207,693.

(51) Int. Cl.

| | |
|---|---|
| ***A41D 13/00*** | (2006.01) |
| ***A41B 1/08*** | (2006.01) |
| ***A41D 27/10*** | (2006.01) |
| *A41D 31/18* | (2019.01) |

(52) U.S. Cl.

CPC ..... *A41D 27/10* (2013.01); *A41B 1/08* (2013.01); *A41D 13/0015* (2013.01); *A41D 31/185* (2019.02); *A41D 2300/32* (2013.01); *A41D 2300/332* (2013.01)

(58) Field of Classification Search

CPC ..... A41D 27/10; A41D 13/0015; A41D 19/0013; A41D 31/185

See application file for complete search history.

(56) References Cited

U.S. PATENT DOCUMENTS

| | | | | |
|---|---|---|---|---|
| 2,513,030 | A * | 6/1950 | Lazarian | A41D 19/0013 2/163 |
| 4,860,385 | A * | 8/1989 | Zidele | A41D 19/0003 2/163 |
| 5,444,874 | A * | 8/1995 | Samelian | A41D 19/0013 2/917 |
| 9,149,073 | B1 | 10/2015 | Hirshberg | |
| 10,117,472 | B2 | 11/2018 | Robbins | |
| 11,344,073 | B2 | 5/2022 | Tyo-Grooten | |
| D1,052,229 | S | 11/2024 | Fultz | |

(Continued)

FOREIGN PATENT DOCUMENTS

| | | | |
|---|---|---|---|
| CN | 115702708 | A | 2/2023 |
| EP | 0662648 | A1 | 7/1995 |

(Continued)

OTHER PUBLICATIONS

List of Patents or Patent Applications Treated as Related dated Dec. 23, 2024, 2 pages.

*Primary Examiner* — Tajash D Patel

(74) *Attorney, Agent, or Firm* — Tutunjian & Bitetto, P.C.

(57) ABSTRACT

A garment that includes sleeves having a side thumb opening for the wearer's thumb also includes means for providing visual access to a wrist worn device when the garment is worn with the wearer's thumb extending through the side/thumb opening. The visual access includes an opening that is either always open or can be selectively open and/or closed.

14 Claims, 8 Drawing Sheets

(56) References Cited

U.S. PATENT DOCUMENTS

| | | | | |
|---|---|---|---|---|
| 12,207,693 | B2 * | 1/2025 | Tutunjian | A41D 27/10 |
| 2004/0190383 | A1 | 9/2004 | Marcucelli | G04B 37/1433 368/278 |
| 2019/0216144 | A1 | 7/2019 | York | A41D 27/085 |
| 2023/0161410 | A1 * | 5/2023 | Ward | A41D 19/0027 345/156 |
| 2023/0255285 | A1 * | 8/2023 | Semling | A41D 19/0013 2/159 |
| 2025/0134189 | A1 * | 5/2025 | Nagaike | A41D 19/0006 |

FOREIGN PATENT DOCUMENTS

| | | | | |
|---|---|---|---|---|
| EP | 4088605 | A1 | 11/2022 | A41D 19/0013 |
| WO | WO-2019053326 | A1 | 3/2019 | |

* cited by examiner

GARMENT

BACKGROUND

Technical Field

The present invention relates to shirts/garments used in a fitness environment. More particularly, it relates to a sleeve modification to shirts/garments used in a fitness or work environment to allow for visual access to a wrist worn device.

Description of the Prior Art

The use of fitness devices such as devices designed to be worn on the athlete's wrist (e.g., smart watches, fitness trackers, heart monitors, etc.) has become commonplace in the world of fitness and sports. However, when the athlete wears long sleeve shirts, these sleeves obstruct the view of the wrist worn fitness device and require the wearer to move or pull up the sleeve to view their wrist worn fitness device.

In addition, many fitness shirts or garments have long sleeves that include a hole in the side of the sleeve that is configured to receive the wearer's thumb, such that only fingers extend from the sleeve end opening. As a result, a portion of fabric remains between the index finger and the thumb when the thumb is extended through the hole in the sleeve. These sleeves cannot be simply pulled up to view the wrist worn device unless the thumb is removed from the hole in the side of the sleeve.

SUMMARY OF THE INVENTION

It is therefore an aspect of the present invention to provide for visual access to a wrist worn device while wearing the long sleeves of a fitness garment, particularly those garments that include a side\thumb opening.

According to one aspect, the fitness garment includes at least one sleeve having a finger opening at one end thereof through which fingers of a wearer extend. A thumb opening is also included in a side of the at least one sleeve and is configured to receive a wearer's thumb. A wrist worn device opening in an upper surface of the at least one sleeve is configured to provide selective visual access to a wrist worn device.

In other implementations, the wrist worn device opening can include an elastic circumference or perimeter. In other implementations, two overlapping layers of material can be used to maintain the wrist worn device opening closed, such that when the wearer manually moves the layers, they can expose the wrist worn device opening, and thus, the wrist worn device.

According to another aspect, a releasably closable flap or the like can be implemented with the use of, for example, hook and look fasteners to selectively covers the wrist worn device opening and thereby selectively provide visual access to a wrist worn device through the opening.

Other aspects and features of the present principles will become apparent from the following detailed description considered in conjunction with the accompanying drawings. It is to be understood, however, that the drawings are designed solely for purposes of illustration and not as a definition of the limits of the present principles, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

In the drawings wherein like reference numerals denote similar components throughout the views.

DETAILED DESCRIPTION

Figure 1A:
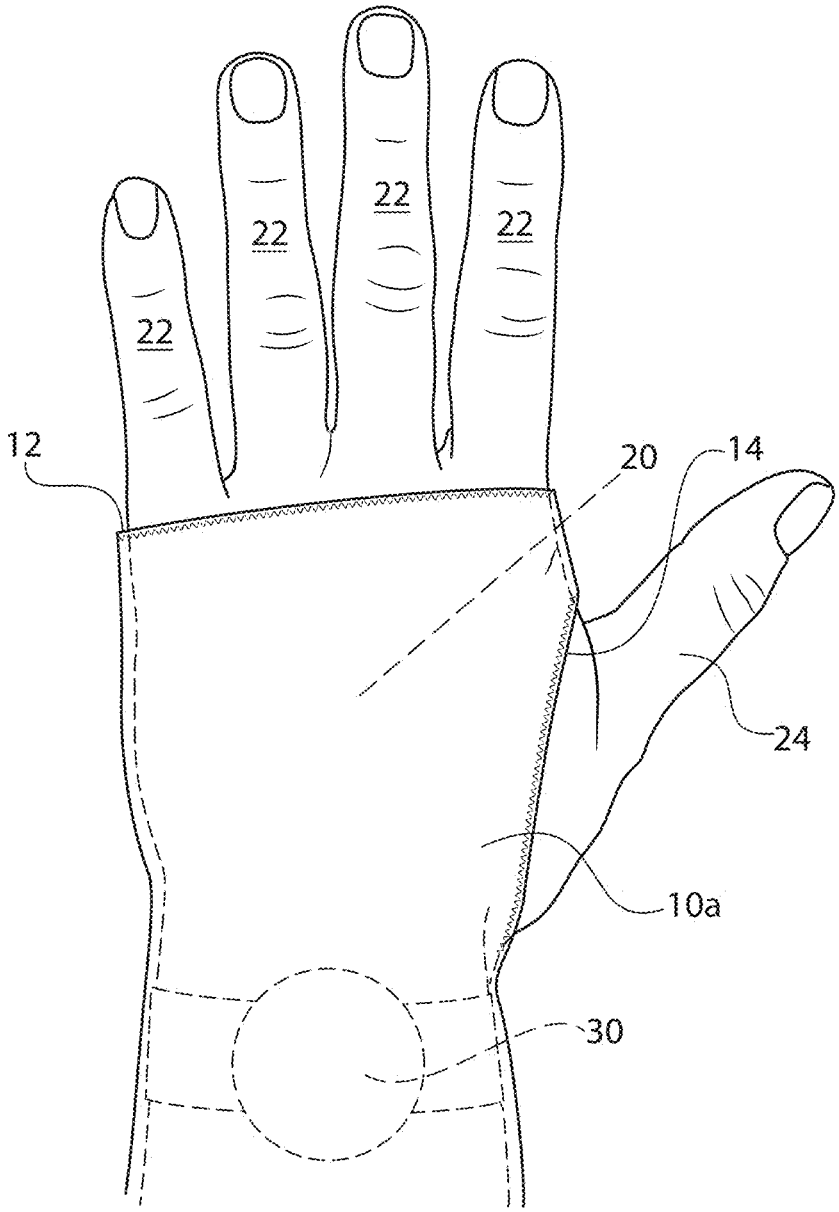
FIG. 1A ( Prior Art )
FIG. 1A is a plan view of a fitness garment of the prior art.

Referring to FIG. 1A, there is shown a fitness garment sleeve 10 of the prior art. The sleeve 10A includes a finger or end opening 12 through which fingers 22 extend, and a side or thumb opening 14 through with the wearer's thumb 24 extends. As shown in broken lines, the wearer is wearing a fitness device 30 on their wrist, however this conventional sleeve does not allow the wearer to view their device 30, without removing their thumb from the side hole 14.

Figure 1B:
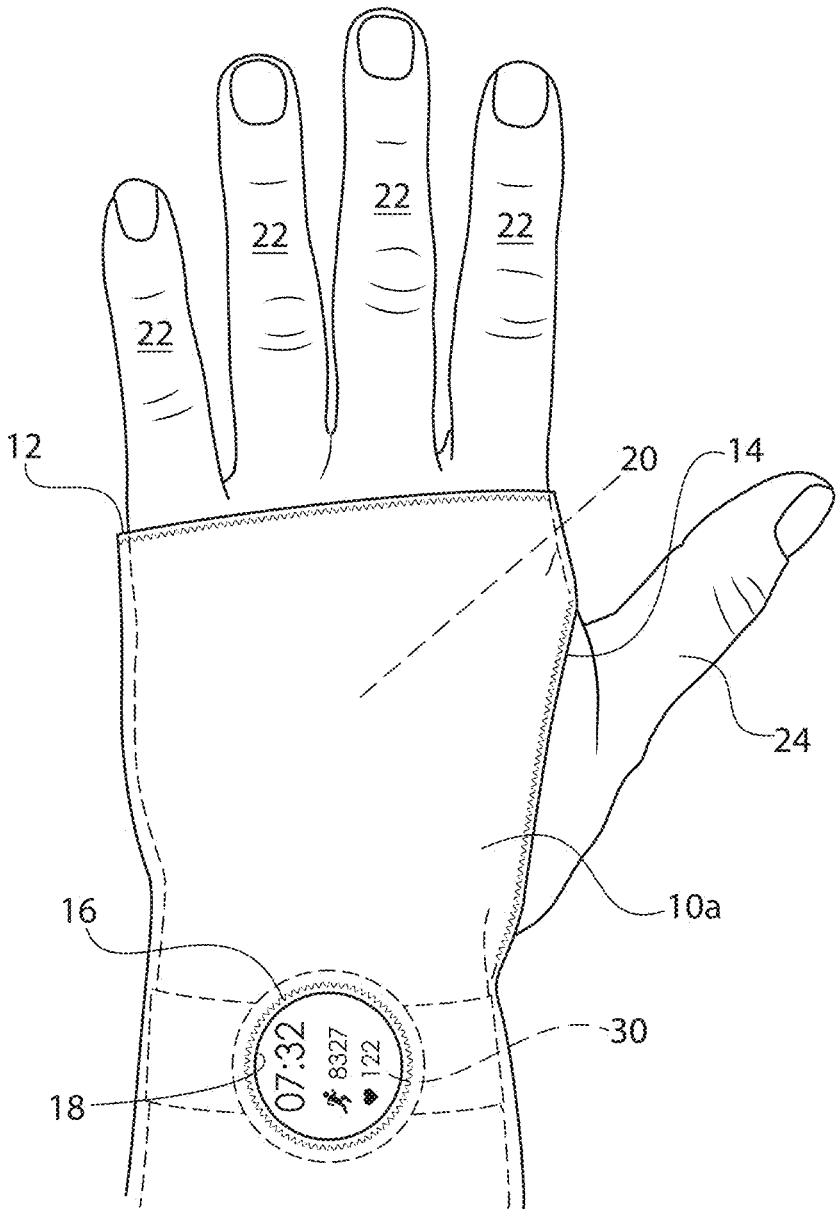
FIG. 1B is a plan view of a fitness garment according to one embodiment of the invention.

FIG. 1B shows a first implementation of the present invention where a wrist worn device opening 18A is formed in the upper surface of the at least one sleeve 10B and positioned so as to allow the wearer to view their fitness device 30. In this implementation, the wrist worn device opening 18A can include an elastic material stitched into the circumference 16 of the same so as to allow for a variable size hole that, in one implementation, can be stretched to fit around the user's wrist worn device 30. Although wrist worn device opening 18A is shown in this embodiment as a circle, it is to be understood and appreciated that various geometric shapes for wrist worn device opening 18A can be used depending on design choice and/or shapes and sizes of various wrist worn devices. The shape can also be related to a brand of the garment and/or a particularly brand endorsement.

The present invention is described in reference to one of the two sleeves of a fitness garment, however, it is to be understood that the present invention can be employed on both sleeves of the fitness garment such that the fitness garment with the present invention can accommodate both left and right handed users/wearers.

Figure 2A:
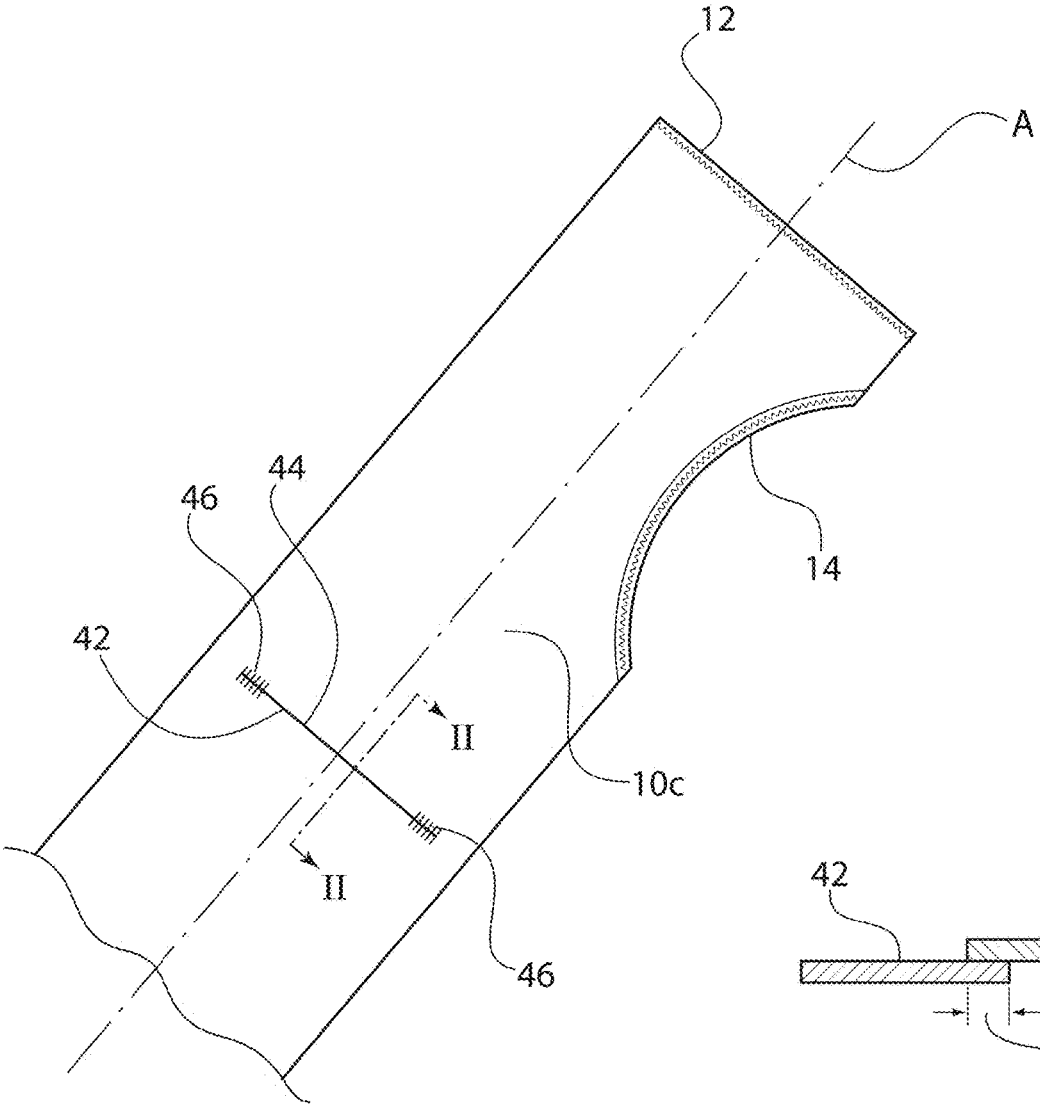
FIGS. 2A-2C show a view of a fitness garment sleeve according to a second embodiment of the invention.
Figure 2B:
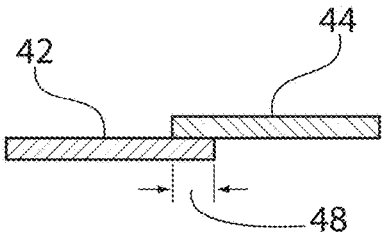
Figure 2C:
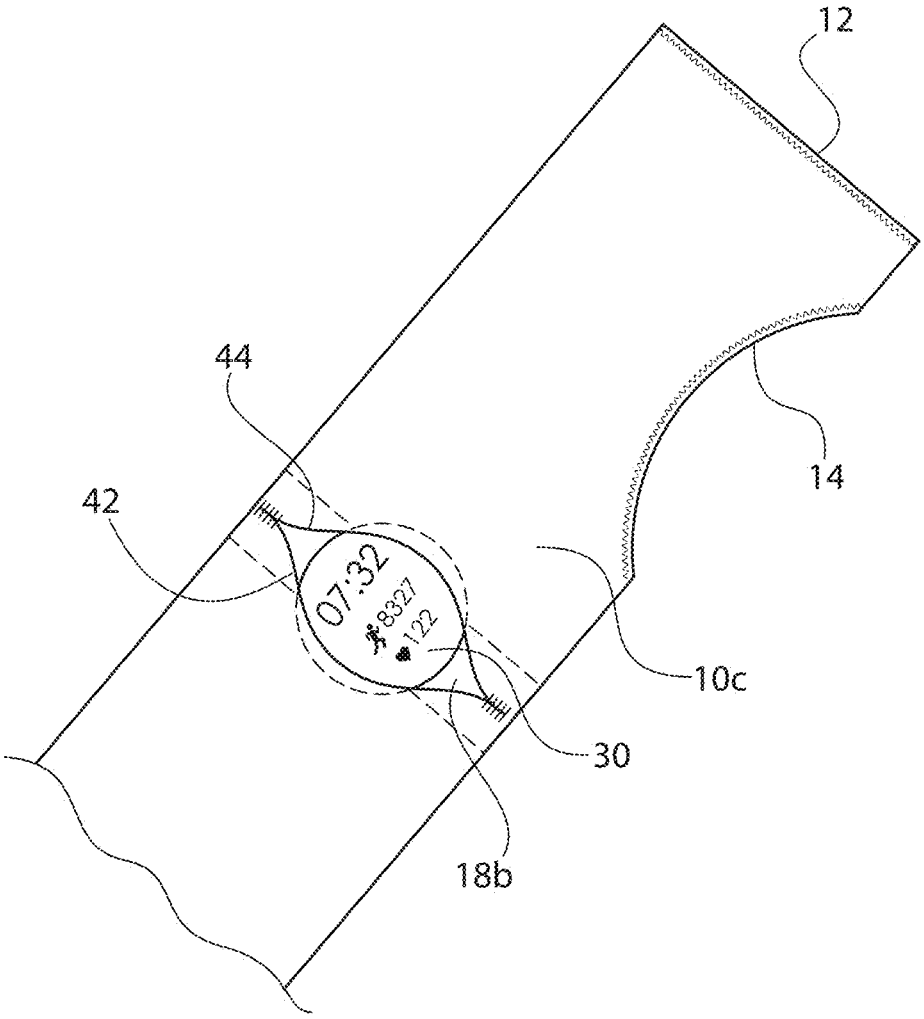

Referring to FIGS. 2A-2C, there is shown another embodiment of the sleeve 10C of the fitness garment according to the invention. In this implementation, a wrist worn device opening 18B is formed by overlapping material 44 and 42 having ends 46 that can be, for example, stitched to prevent tearing of the layers. The spacing or amount of overlap 48 shall be just enough to maintain the wrist worn device opening 18B closed until the user wants to view their wrist worn device 30. In this configuration, the wearer can selectively open the wrist worn device opening 18B through the garment and view their wrist worn fitness device 30 by simply moving the layers 44, 42 of material operating to maintain the wrist worn device opening 18B closed. Since the material of the fitness garment often contains elastic properties, the overlapping layers 44 and 42 will automatically return to their closed position when not being moved by the user. In other embodiments for garments that do not include elastic properties, such elastic properties can be imparted on the layers 44 and 42 using elastic material stitched or included into the same. In this embodiment, the layers 42, 44 that form the wrist worn device opening 18B are configured such that the opening of the same is transverse to a longitudinal axis A of the sleeve 10C.

Figure 3A:
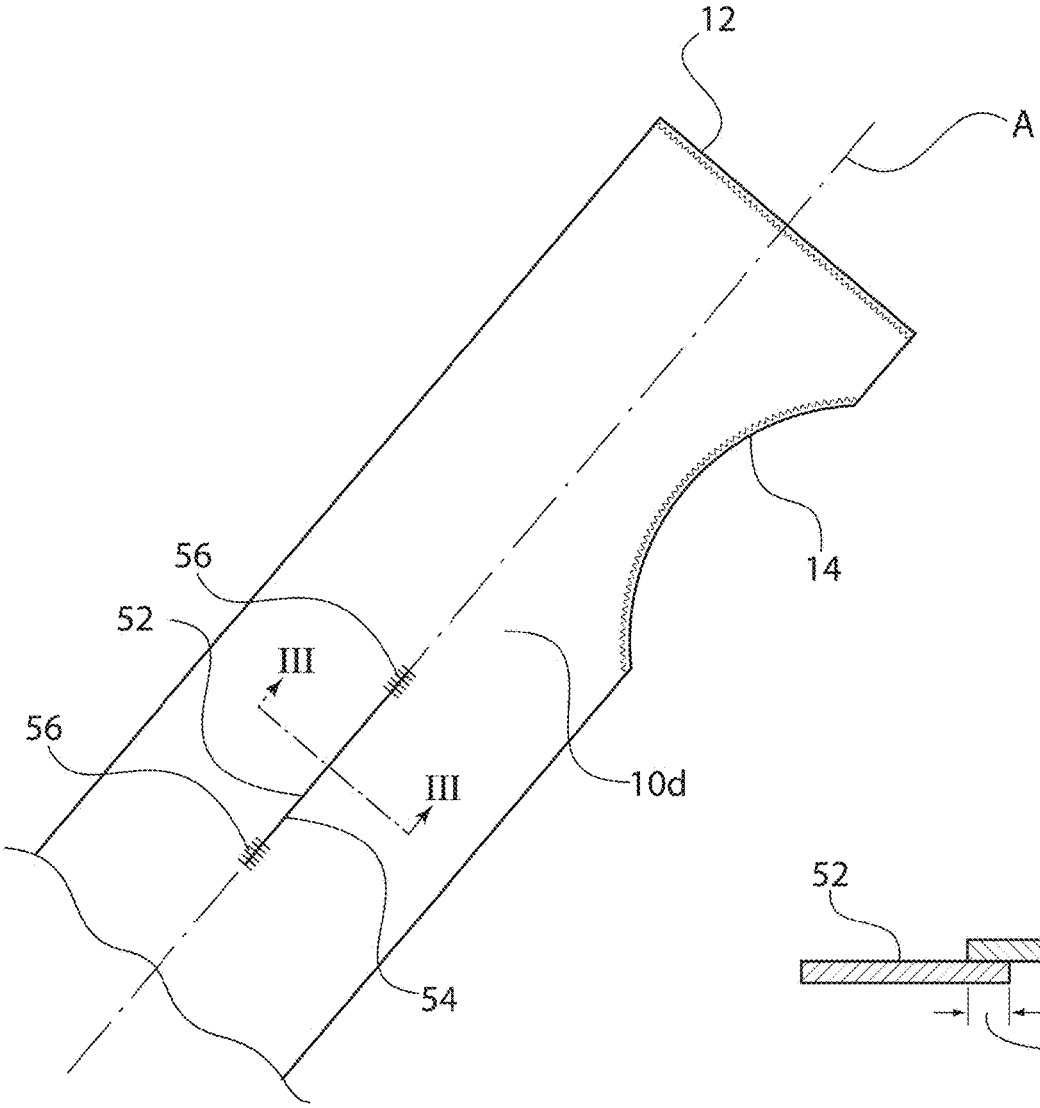
FIGS. 3A-3C show a view of a fitness garment sleeve according to a third embodiment of the invention.
Figure 3B:
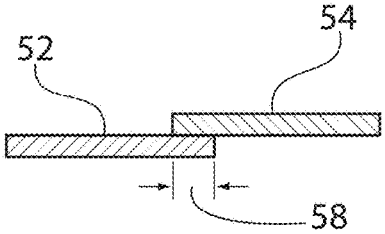
Figure 3C:
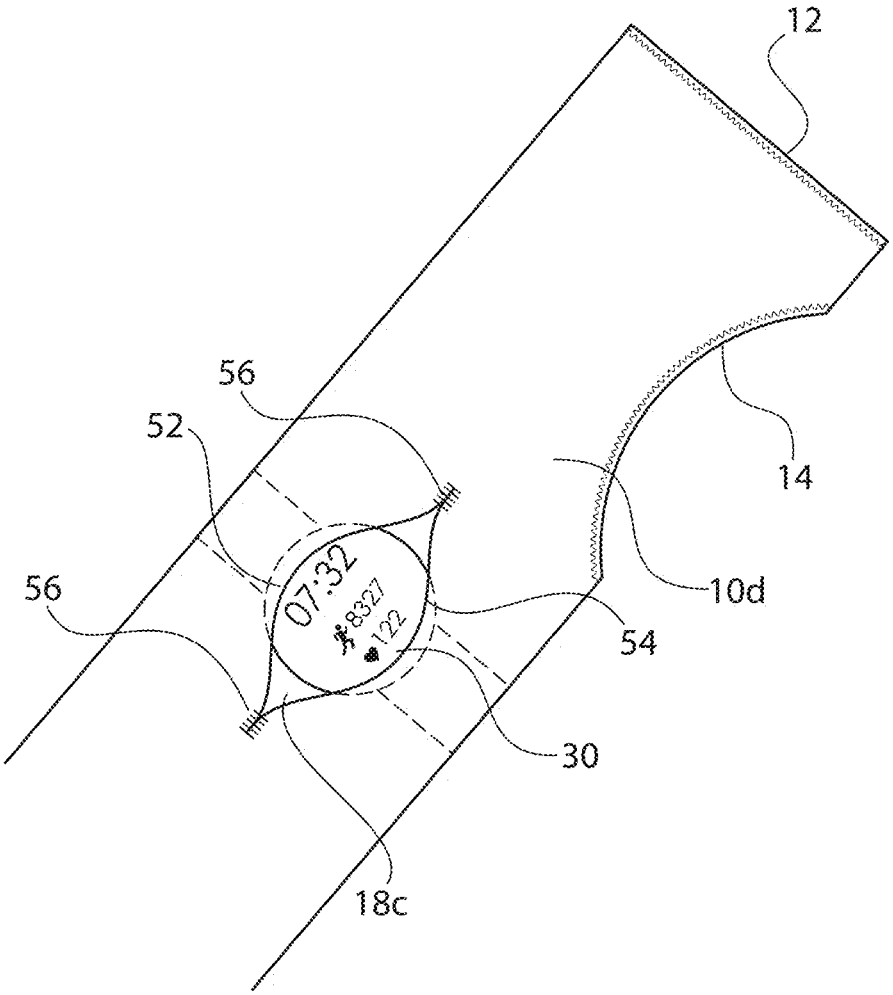
Figure 4A:
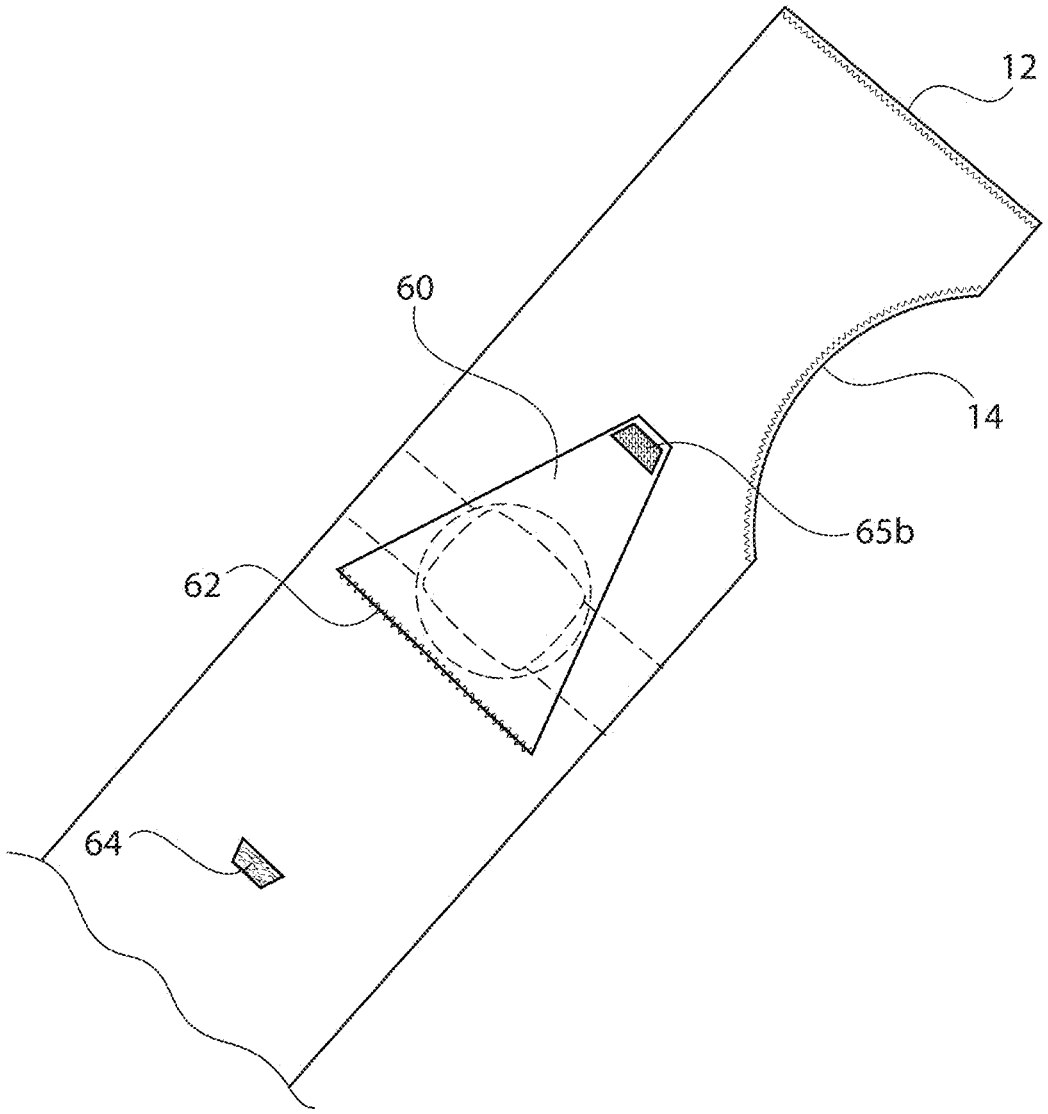
FIGS. 4A-4B show a view of a fitness garment sleeve according to a fourth embodiment of the invention.
Figure 4B:
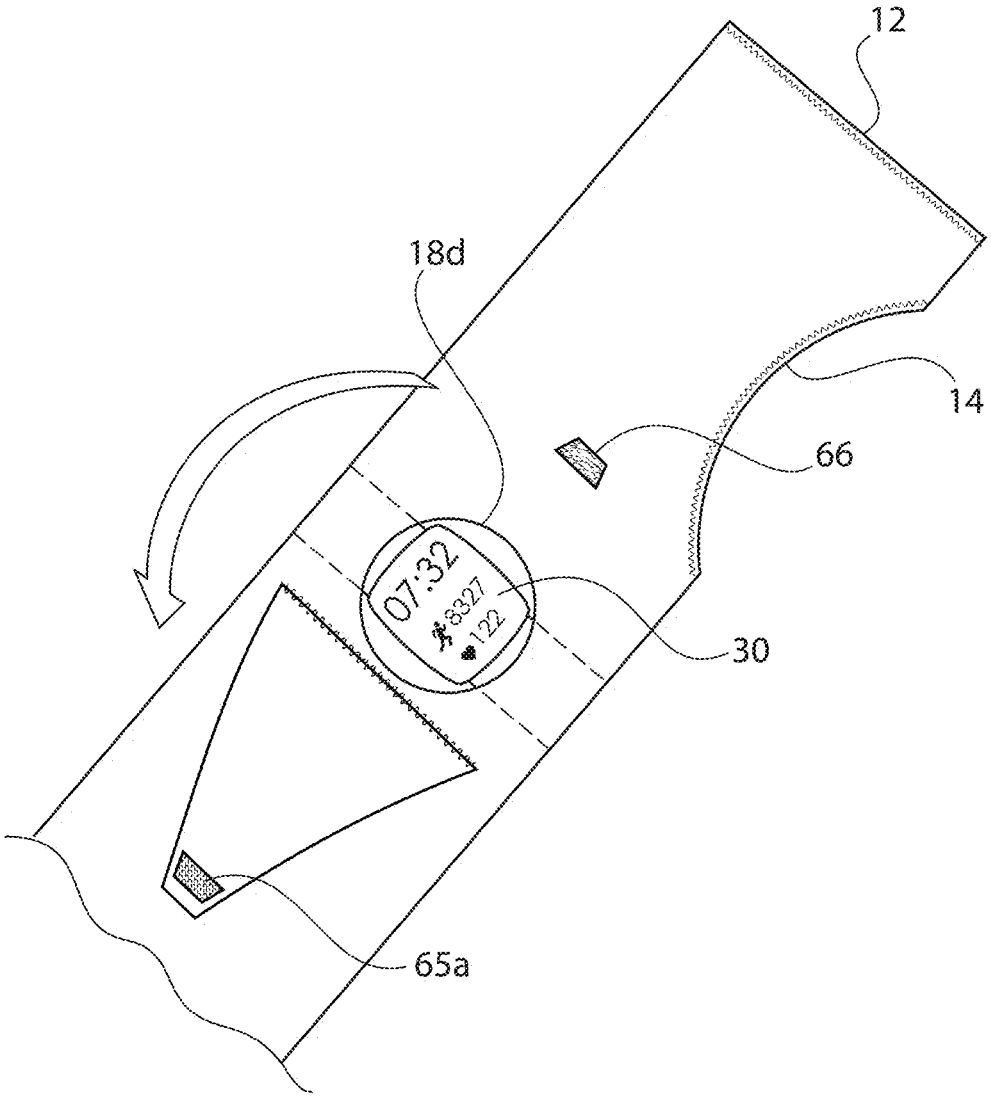

Referring to FIGS. 3A-3C, an alternative embodiment is shown where the overlapping layers 52, 54 with corresponding stitching 56 is aligned with the longitudinal axis A of the sleeve 10C. The spacing or amount of overlap 58 is just enough to maintain the wrist worn device opening 18C closed when not in use and the overlapping layers can be easily moved at the demand of the wearer to view their fitness device 30. Since the material of the fitness garment often contains elastic properties, the overlapping layers 54 and 52 will automatically return to their closed position when not being moved by the user. In other embodiments for garments that do not include elastic properties, such elastic properties can be imparted on the layers 54 and 52 using elastic material stitched or included into the same. In this embodiment, the layers 52, 54 that form the wrist worn device opening 18C are configured such that the opening of the same is transverse to a longitudinal axis A of the sleeve 10D FIGS. 4A and 4B show yet another embodiment of the invention where the wrist worn device opening 18D is formed in the upper surface of the sleeve material, and a separate access flap 60 is provided that can be selectively opened to reveal visual access to the fitness device 30 on the wearer's wrist. In this implementation, the flap 60 can take any shape, and would be, for example, stitched at one end 62 so as to maintain the flap 60 on the sleeve at all times.

According to one implementation, at an opposing end of the flap 60 is a hook and loop fastener 65A that is configured to align with a correspondingly positioned hook and loop material 66 on the sleeve surface. In this manner, the flap 60 is maintained closed and thus the wrist worn device opening 18D, and corresponding wrist device 30 is not visually accessible. When the user wants visual access to their fitness device 30, they simply lift the flap 60 to release the first hook and loop fasteners 65A, 66.

In another implementation, a second hook and loop fastener 65B can be provided on the outer surface of the flap 60 and is configured to align with a second hook and loop fastener 64 positioned on an opposing side of the wrist worn device opening 18D such that the flap 60 can be secured in an open position, thus maintaining the wrist worn device opening 18D, and thereby the fitness device 30 visually accessible to the wearer.

The embodiments shown in FIGS. 4A and 4B show a flap 60 having a trapezoidal shape. However, it will be appreciated that the geometric shape of the flap 60 can be modified according to a particular design preference or can be configured to include or carry marketing or other promotional materials associated with the fitness garment or any other brand.

While there have been shown, described and pointed out fundamental novel features of the present principles, it will be understood that various omissions, substitutions and changes in the form and details of the methods described and devices illustrated, and in their operation, may be made by those skilled in the art without departing from the spirit of the same. It is the intention, therefore, to be limited only as indicated by the scope of the claims appended hereto.

It should also be understood that the example embodiments disclosed and taught herein are susceptible to numerous and various modifications and alternative forms. Thus, the use of a singular term, such as, but not limited to, "a" and the like, is not intended as limiting of the number of items. Furthermore, the naming conventions for the various components, functions, parameters, thresholds, and other elements used herein are provided as examples, and can be given a different name or label. The use of the term "or" is not limited to exclusive "or" but can also mean "and/or".

While particular embodiments and applications of the present disclosure have been illustrated and described, it is to be understood that the present disclosure is not limited to the precise construction and compositions disclosed herein and that various modifications, changes, and variations can be apparent from the foregoing descriptions without departing from the invention as defined in the appended claims.

Having described preferred embodiments, which serve to illustrate various concepts, structures and techniques that are the subject of this patent, it will now become apparent to those of ordinary skill in the art that other embodiments incorporating these concepts, structures and techniques may be used. Additionally, elements of different embodiments described herein may be combined to form other embodiments not specifically set forth above.

Accordingly, it is submitted that that scope of the patent should not be limited to the described embodiments but rather should be limited only by the spirit and scope of the following claims.

What is claimed is:

1. A garment comprising:

at least one long sleeve having two openings, a first of the two openings defined as a hand opening at an end of the sleeve through which a wearer's hand and all fingers except a thumb extend, and a second of the two openings defined as thumb opening in the at least one long sleeve adjacent the first opening, the second opening configured to receive the wearer's thumb; and a wrist worn device opening in a surface of the at least one long sleeve configured to provide visual access to a wrist worn device, the wrist worn device opening comprising a first layer and a second layer slightly overlapping the first layer, wherein movement of the first layer and second layer provides visual access to the wrist worn device.

2. The garment of claim 1, wherein the first layer and second layer are configured to be transverse to a longitudinal axis of the at least one sleeve.

3. The garment of claim 1, wherein the first layer and the second layer are configured to align with a longitudinal axis of the at least one sleeve.

4. The garment of claim 1, further comprising a flap configured to selectively cover the wrist worn device opening.

5. The garment of claim 4, wherein the flap comprises one end fixedly attached to the at least one sleeve on one side of the wrist worn device opening, and an attachment device on an opposing end of the flap and opposing side of the wrist worn device opening, wherein the attachment device allows for selective covering of the wrist worn device opening and uncovering of the wrist worn device opening, based on the wearer's preference.

6. A garment comprising:

two sleeves each having two openings, one opening being at a distal end configured to receive a wearer's hand and their fingers except their thumb, and a second opening defined as a thumb opening in a side of the sleeve near the first opening to receive the wearer's thumb; and a wrist worn device opening in a surface of each of the two sleeves configured to provide visual access to a wrist worn device when the garment is being worn by a wearer and the wearer's thumb is extending through the thumb opening, the wrist worn device opening having a circumference and an elastic material integrated into the circumference.

7. The garment of claim 6, further comprising a flap configured to selectively cover the wrist worn device opening.

8. The garment of claim 7, wherein the flap comprises one end fixedly attached to the sleeves on one side of the wrist worn device opening, and an attachment device on an opposing end of the flap and opposing side of the wrist worn device opening, wherein the attachment device allows for selective covering of the wrist worn device opening and uncovering of the wrist worn device opening, based on the wearer's preference.

9. A garment comprising:

at least one sleeve having a hand opening at an end of the sleeve through which a wearer's hand and all fingers except a thumb extend, and a second opening defined as thumb opening in the at least one long sleeve positioned near the hand opening;

a wrist worn device opening in a surface of the at least one sleeve configured to provide visual access to a wrist worn device; and a system for selectively changing the visual access to the wrist worn device.

10. The garment of claim 9, wherein the system for selectively changing the visual access to the wrist worn device comprises configuring the wrist worn device opening comprising:

a first layer; and a second layer partially overlapping the first layer, wherein movement of one of the first layer and second layer to fit around the wrist worn device provides visual access to the wrist worn device.

11. The garment of claim 9, wherein the first layer and second layer are configured to be transverse to a longitudinal axis of the at least one sleeve.

12. The garment of claim 9, wherein the first layer and the second layer are configured to align with a longitudinal axis of the at least one sleeve.

13. The garment of claim 9, wherein the system for selectively changing the visual access to the wrist worn device comprises a flap.

14. The garment of claim 13, wherein the flap comprises one end fixedly attached to the sleeve adjacent the wrist worn device opening, and an attachment device on an opposing end of the flap and opposing side of the wrist worn device opening.

* * * * *